US006291121B1

(12) United States Patent
Hollenbaugh, Jr. et al.

(10) Patent No.: US 6,291,121 B1
(45) Date of Patent: Sep. 18, 2001

(54) FLUORESCENT TREATED EXTERNAL SURFACE ADDITIVES FOR TONER

(75) Inventors: William H. Hollenbaugh, Jr.; Timothy L. Lincoln; Roger N. Ciccarelli, all of Rochester; Thomas R. Pickering; Dwight J. Tshudy, both of Webster; Robin L. Sheppard, Canandaigua; Amy L. Stamp, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/667,232

(22) Filed: Sep. 22, 2000

(51) Int. Cl.[7] ..... G03G 9/09
(52) U.S. Cl. ..... 430/108.7
(58) Field of Search ..... 430/106, 109, 430/110, 111, 108.7

(56) References Cited

U.S. PATENT DOCUMENTS

| | | | | |
|---|---|---|---|---|
| 3,590,000 | | 6/1971 | Palermiti et al. . | |
| 4,298,672 | | 11/1981 | Lu . | |
| 4,338,390 | | 7/1982 | Lu . | |
| 4,558,108 | | 12/1985 | Alexandru et al. . | |
| 5,105,451 | * | 4/1992 | Lubinsky et al. | 378/28 |
| 5,227,460 | | 7/1993 | Mahabadi et al. . | |
| 5,714,291 | * | 2/1998 | Marinello et al. | 430/106 |

* cited by examiner

*Primary Examiner*—John Goodrow
(74) *Attorney, Agent, or Firm*—Oliff & Berridge, PLC; Eugene O. Palazzo

(57) ABSTRACT

Detection of the presence and amount of an external surface additive such as silica upon the surface of a toner is accomplished by treating the external surface additive with a fluorescent material and exposing the toner to ultraviolet light. This permits accurate quality control over the amount of the external surface additive required for the toner. The toner thus includes a binder resin and a colorant, and at least one external surface additive upon the surface of the toner, wherein the at least one external surface additive contains a fluorescent material. The fluorescent material may be a fluorescein dye.

17 Claims, No Drawings

FLUORESCENT TREATED EXTERNAL SURFACE ADDITIVES FOR TONER

BACKGROUND OF THE INVENTION

1. Field of Invention

The invention relates to external surface additives for toners that have been treated with a fluorescent material. More in particular, the invention relates to a quality control method for identifying the presence and amount of an external surface additive of a toner through treatment of the target additive with a fluorescent dye.

2. Description of Related Art

Toners for use in modern xerographic printing machines are required to have specific properties, for example conductivity and triboelectric charging properties. The properties of a toner are set through the selection of materials and amounts of the materials of the toner. To ensure that the toner being produced will possess the requisite properties, it is thus necessary to carefully control the amounts of the materials used in making the toner.

Toners typically comprise at least a binder resin, a colorant and external surface additives. The external surface additives are generally added in small amounts. Examples of surface additives include, for example, silica, titanium dioxide, zinc stearate, etc. Prior to the present invention, various conventional analytical techniques were used to detect the presence and amounts of the various additives. For example, for detecting silica as an external additive, techniques such as X-ray Fluorescence and Inductively Coupled Plasma Spectroscopy have been used. Both of these methods utilize the characteristic light or x-ray energy emission of silicon (Si) at specific wavelengths to quantify the silica ($SiO_2$). After measuring the silicon (Si) concentration, the silica ($SiO_2$) level is then calculated. However, in a case where two different additives of the same type, for example two different silica additives, are present in the toner, these conventional techniques are unable to distinguish between the two additives.

What is desired, then, is an improved technique for determining the presence and amount of certain external surface additives in a toner.

SUMMARY OF THE INVENTION

It is thus an object of the present invention to develop an improved method for detecting and measuring the presence and amount of an external surface additive of a toner. It is a still further object of the invention to develop such technique that does not adversely affect the properties of the toner. It is a still further object of the present invention to develop a toner and surface additives therefor which can be readily discerned for quality control purposes.

These and other objects of the present invention are achieved by treating an external surface additive of a toner with an amount of a fluorescent material, thereby enabling detection and quantification of the treated external additive with ultraviolet light. The invention thus also includes a toner having an external surface additive that has been treated with a fluorescent material.

DETAILED DESCRIPTION OF PREFERRED EMBODIMENTS

This invention is applicable to the treatment of any external surface additives of any toner composition. The toners may be used in forming known developer compositions, for example one-component and two-component (with carrier particles) developer compositions, without restriction. The toners can be used in developing images in any type of xerographic printing apparatus, for example such as a single component developer unit, magnetic brush developer unit, hybrid jumping developer unit, or hybrid scavengeless developer unit.

Four different color toners, cyan (C), magenta (M), yellow (Y) and black (K), are typically used in developing full color images (although other color toners may also be used). These and other color toners may be prepared in the present invention, without restriction. Each color toner is preferably comprised of at least a resin binder, appropriate colorants, optional internal additives and an external additive package comprised of one or more external surface additives. Suitable and preferred materials for use in preparing toners of the invention will now be discussed.

Illustrative examples of suitable toner resins selected for the toner compositions include vinyl polymers such as styrene polymers, acrylonitrile polymers, vinyl ether polymers, acrylate and methacrylate polymers; epoxy polymers; diolefins; polyurethanes; polyamides and polyimides; polyesters such as the polymeric esterification products of a dicarboxylic acid and a diol comprising a diphenol, crosslinked polyesters; and the like. The polymer resins include homopolymers or copolymers of two or more monomers. Polyester resins are typically a most preferred binder resin. Furthermore, the above-mentioned polymer resins may also be crosslinked.

Illustrative vinyl monomer units in the vinyl polymers include styrene, substituted styrenes such as methyl styrene, chlorostyrene, styrene acrylates and styrene methacrylates; vinyl esters like the esters of monocarboxylic acids including methyl acrylate, ethyl acrylate, n-butyl-acrylate, isobutyl acrylate, propyl acrylate, pentyl acrylate, dodecyl acrylate, n-octyl acrylate, 2-chloroethyl acrylate, phenyl acrylate, methylalphachloracrylate, methyl methacrylate, ethyl methacrylate, butyl methacrylate, propyl methacrylate, and pentyl methacrylate; styrene butadienes; vinyl chloride; acrylonitnle; acrylamide; alkyl vinyl ether and the like. Further exampleg include p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl indole, N-vinyl pyrrolidone; and the like.

Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol units in the polyester resins include ethanediol, propanediols, butanediols, pentanediols, pinacol, cyclopentanediols, hydrobenzoin, bis(hydroxyphenyl) alkanes, dihydroxybiphenyl, substituted dihydroxybiphenyls, and the like.

As one toner resin, there are selected polyester resins derived from a dicarboxylic acid and a diphenol. These resins are illustrated in U.S. Pat. No. 3,590,000, the disclosure of which is totally incorporated herein by reference. Also, polyester resins obtained from the reaction of bisphenol A and propylene oxide, and in particular including such polyesters followed by the reaction of the resulting product with fumaric acid, and branched polyester resins resulting from the reaction of dimethylterephthalate with 1,3-butanediol, 1,2-propanediol, and pentaerythritol may also preferable be used. Further, low melting polyesters, especially those prepared by reactive extrusion, reference U.S. Pat. No. 5,227,460, the disclosure of which is totally incorporated herein by reference, can be selected as toner resins. Other specific toner resins may include styrene-methacrylate copolymers, styrenebutadiene copolymers, PLIOLITES™, and suspension polymerized styrenebutadienes (U.S. Pat. No. 4,558,108, the disclosure of which is totally incorporated herein by reference).

Resin binders for use in the present invention may also include polyester resins containing both linear portions and cross-linked portions of the type described in U.S. Pat. No. 5,227,460 (incorporated herein by reference above).

The cross-linked portion may consist essentially of very high molecular weight microgel particles with high density cross-linking (as measured by gel content) and which are not soluble in substantially any solvents such as, for example, tetrahydrofuran, toluene and the like. The microgel particles are highly cross-linked polymers with a very small, if any, cross-link distance. This type of cross-linked polymer may be formed by reacting chemical initiator with linear unsaturated polymer, and more preferably linear unsaturated polyester, at high temperature and under high shear. The initiator molecule breaks into radicals and reacts with one or more double bond or other reactive site within the polymer chain forming a polymer radical. This polymer radical reacts with other polymer chains or polymer radicals many times, forming a highly and directly cross-linked microgel. This renders the microgel very dense and results in the microgel not swelling very well in solvent. The dense microgel also imparts elasticity to the resin and increases its hot offset temperature while not affecting its minimum fix temperature.

Linear unsaturated polyesters used as the base resin are low molecular weight condensation polymers which may be formed by the step-wise reactions between both saturated and unsaturated diacids (or anhydrides) and dihydric alcohols (glycols or diols). The resulting unsaturated polyesters are reactive (e.g., cross-linkable) on two fronts: (i) unsaturation sites (double bonds) along the polyester chain, and (ii) functional groups such as carboxyl, hydroxy, etc., groups amenable to acid-base reactions. Typical unsaturated polyester base resins useful for this invention are prepared by melt polycondensation or other polymerization processes using diacids and/or anhydrides and diols. Suitable diacids and dianhydrides include but are not limited to saturated diacids and/or anhydrides such as for example succinic acid, glutaric acid, adipic acid, pimelic acid, suberic acid, azelaic acid, sebacic acid, isophthalic acid, terephthalic acid, hexachloroendo methylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like and mixtures thereof; and unsaturated diacids and/or anhydrides such as for example maleic acid, fumaric acid, chloromaleic acid, methacrylic acid, acrylic acid, itaconic acid, citraconic acid, mesaconic acid, maleic anhydride, and the like and mixtures thereof. Suitable diols include but are not limited to for example propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and the like and mixtures thereof, soluble in good solvents such as, for example, tetrahydrofuran, toluene and the like.

Preferred unsaturated polyester base resins are prepared from diacids and/or dianhydrides such as, for example, maleic anhydride, fumaric acid, and the like and mixtures thereof, and diols such as, for example, propoxylated bisphenol A, propylene glycol, and the like and mixtures thereof. A particularly preferred polyester is poly (propoxylated bisphenol A fumarate).

The toner binder resin may comprise a melt extrusion of (a) linear propoxylated bisphenol A fumarate resin and (b) this resin cross-linked by reactive extrusion of this linear resin, with the resulting extrudate comprising a resin with an overall gel content of from about 1 to about 40 weight percent and preferably from about 2 to about 8 weight percent for a high gloss color toner. Linear propoxylated bisphenol A fumarate resin is available under the tradename SPARII from Resana S/A Industrias Quimicas, Sao Paulo Brazil, or as Neoxyl P2294 or P2297 from DSM Polymer, Geleen, The Netherlands, for example.

Chemical initiators such as, for example, organic peroxides or azo-compounds may be used for making the cross-linked toner resins. Suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di(2-ethyl hexanoyl peroxy)hexane, t-amnyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-igopropyl mono peroxy carbonate, 2,5-dimethyl 2,5-di(benzoyl peroxy)hexane, oo-t-butyl o-(2-ethyl hexyl)mono peroxy carbonate, and oo-t-amyl o-(2-ethyl hexyl)mono peroxy carbonate, alkyl peroxides such as, for example, dicumyl peroxide, 2,5-dimethyl 2,5-di(t-butyl peroxy)hexane, t-butyl cumyl peroxide, bis(t-butyl peroxy) diisopropyl benzene, di-t-butyl peroxide and 2,5-dimethyl 2,5-di(t-butyl peroxy)hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di(t-butyl peroxy)valerate, 1,1-di(t-butyl peroxy)3,3,5-trimethyl cyclohexane, 1,1-di(t-butyl peroxy) cyclohexane, 1,1-di(t-amyl peroxy) cyclohexane, 2,2-di(t-butyl peroxy)butane, ethyl 3,3-di(t-butyl peroxy)butyrate, ethyl 3,3-di(t-amyl peroxy) butyrate and 1,1-bis(t-butyl (peroxy)3,3,5-trimethylcyclohexane. Suitable azo-compounds include azobis-isobutyronitrile, 2,2'-azobis (isobutyronitrile), 2,2'-azobis(2,4-dimethyl valeronitrile), 2,2'-azobis(methyl butyronitrile), 1,1'-azobis(cyano cyclohexane) and other similar known compounds.

The toner resins can be subsequently melt blended or otherwise mixed with a colorant, charge carrier additives, surfactants, emulsifiers, pigment dispersants, flow additives, embrittling agents, and the like. The resultant product can then be pulverized by known methods such as milling to form toner particles. If desired, waxes with a molecular weight of from about 1,000 to about 7,000, such as polyethylene, polypropylene, and paraffin waxes, can be included in or on the toner compositions as fusing release agents.

Various suitable colorants of any color without restriction can be employed in toners of the invention, including suitable colored pigments, ayes, and mixtures thereof. Examples of suitable colorants include carbon black, such as Regal 330 carbon black (Cabot), Acetylene Black, Lamp Black, Aniline Black, nigrosine dye, metal phthalocyanines, aniline blue, magnetite, Chrome Yellow, Zinc Yellow, Sicofast Yellow, Sunbrite Yellow, Luna Yellow, Novaperm Yellow, Chrome Orange, Bayplast Orange, Cadmium Red, Lithol Scarlet, Hostaperm Red, Fanal Pink, Hostaperm Pink, Lithol Red, Rhodamine Lake B, Brilliant Carmine, Heliogen Blue, Hostaperm Blue, Neopan Blue, PV Fast Blue, Cinquassi Green, Hostaperm Green, titanium dioxide, cobalt, nickel, iron powder, Sicopur 4068 FF, and iron oxides such as Mapico Black (Columbia), NP608 and NP604 (Northern Pigment), Bayferrox 8610 (Bayer), MO8699 (Mobay), TMB-100 (Magnox), mixtures thereof and the like.

The colorant, preferably black, cyan, magenta and/or yellow colorant, is incorporated in an amount sufficient to impart the desired color to the toner. In general, pigment or dye is employed in an amount ranging from about 2 to about 20 percent by weight, and preferably from about 3 to about 15 percent by weight for color toner and about 3 to about 10 percent by weight for black toner.

The toner composition of the present invention can be prepared by a number of known methods including melt blending the toner resin particles, and pigment particles or colorants followed by mechanical attrition. Other methods include those well known in the art such as spray drying, melt dispersion, dispersion polymerization, suspension polymerization, and extrusion.

The toner is preferably made by first mixing the binder, the colorant and any other internal additives together in a mixing device, preferably an extruder, and then extruding the mixture. The cooled extruded mixture is then preferably micronized in a grinder. The toner is then classified to form a toner with the desired volume median particle size, for example of from 5 to 15 micrometers. Care should also be taken in the method in order to limit the coarse particles, grits, giant particles and very small particles. Subsequent toner blending of the external additive package is then preferably accomplished using a mixer or blender, for example a Henschel mixer, followed by screening to obtain the final toner product.

Any suitable external surface additives may be used in the present invention. Most preferred in the present invention are one or more of $SiO_2$ (silica), metal oxides such as, for example, $TiO_2$ (titania) and aluminum oxide, and a lubricating agent such as, for example, a metal salt of a fatty acid (e.g., zinc stearate (ZnSt), calcium stearate) or long chain alcohols such as Unilin 700, as external surface additives. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability.

The $SiO_2$ and $TiO_2$ should preferably have a primary particle size of from about 5 nm to greater than approximately 30 nm, preferably of at least 40 nm, with the primary particle size measured by, for instance, transmission electron microscopy (TEM) or calculated (assuming spherical particles) from a measurement of the gas absorption, or BET, surface area. The $SiO_2$ and $TiO_2$ are preferably applied to the toner surface with the total coverage of the toner ranging from, for example, about 100 to 200% theoretical surface area coverage (SAC), where the theoretical gAC (hereafter referred to as SAC) is calculated assuming all toner particles are spherical and have a diameter equal to the volume median diameter of the toner as measured in the standard Coulter counter method, and that the additive particles are distributed as primary particles on the toner surface in a hexagonal closed packed structure.

The most preferred $SiO_2$ and $TiO_2$ have been surface treated with compounds including DTMS (decyltrimethoxysilane) or HMDS (hexamethyldisilazane). Examples of these additives are: NA50HS silica, obtained from DeGussa/Nippon Aerosil Corporation, coated with a mixture of HMDS and aminopropyltriethoxysilane; DTMS silica, obtained from Cabot Corporation, comprised of a fumed silica, for example silicon dioxide core L90 coated with DTMS; H2050, obtained from Wacker Chemie, a highly hydrophobic fumed silica with a coating of polydimethyl siloxane units and with amino/ammonium finctions chemically bonded onto the surface, i.e., coated with an amino functionalized organopolysiloxane; and SMT5103, obtained from Tayca Corporation, comprised of a crystalline titanium dioxide core coated with DTMS.

Zinc stearate may also be used as an external additive for the toners, the zinc stearate providing lubricating properties. Zinc stearate provides developer conductivity and triboelectric enhancement, both due to its lubricating nature. In addition, zinc stearate enables higher toner charge and charge stability by increasing the number of contacts between toner and carrier particles. Calcium stearate and magnesium stearate provide similar functions. Most preferred is a commercially available zinc stearate having a particle size that passes through a 325 screen and is known as Zinc Stearate L made by Ferro Corporation, Polymer Additives Division.

For further enhancing the negative charging characteristics of the developer compositions described herein, and as optional components there can be incorporated into the toner or on its surface charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfates, and the like and other Similar known charge enhancing additives. Also, negative charge enhancing additives may also be selected, such as aluminum complexes, like BONTRON E-88, and the like.

Each of the external additive materials, when present, are typically present in small amounts compared to the weight of the toner. For example, any of the foregoing external additives may comprise from about 0.1 to about 8.0 weight percent of the toner particle. These amounts of external additives can be difficult to detect by analysis. In addition, for any given toner, the amounts of each external additive used must be carefully controlled in order for the toner to possess the requisite properties, for example triboelectric charging and charge stability. In other words, the amounts and ratios of the external additives can be manipulated to provide a range of toner charge. Thus, it is necessary to be able to verify that the toner produced contains the correct amount of additives. The total amount of external additives present on the toner should preferably be, for example, less than 10% by weight of the toner particle.

In certain toners, for example the yellow and cyan toners described in co-pending application Ser. No. 09/520,439, incorporated herein by reference in its entirety, the external additive package may include two different types of silicas, one a "positive" silica and one a "negative" silica (in standard toner blend formulations, silicas are typically referred to by the charge modification they impart to the toner particle). The "negative" polarity silica imparts a higher negative charge to the toner, or decreases the positive toner charge (depending on the polarity and magnitude of the base toner charge). Correspondingly, the "positive" polarity silica imparts a higher positive charge to the toner, or decreases the negative toner charge (again, depending on the polarity and magnitude of the base toner charge). The negative silica may be a silica treated with HMDS or DTMS, while the positive silica may be Wacker Chemie's H2050. With conventional quality control techniques, it is not possible to distinguish between these different types of silicas, and thus not possible to do accurate quality control with respect to the amount of each of these external additives incorporated onto the toner.

To address this, in the present invention, one of the external additives is treated with a fluorescent material. In a most preferred embodiment, the external additive treated with the fluorescent material is a silica. In the case where two different types of silicas are present as external additives, only one of the silicas is treated to enable ready distinction between the two classes of silicas in quality control.

By "fluorescent material" as used herein is intended any material exhibiting fluorescence while being acted upon by radiant energy such as ultraviolet rays or X-rays. Suitable materials may be solid or liquid, organic or inorganic, and include, for example, any well-known fluorescent crystals or fluorescent dyes. Fluorescent dyes have most typically been used in labeling molecules in biochemical research.

In a preferred embodiment, the external additive is treated with a fluorescent dye. Any known fluorescent dye may be used. Suitable dyes include, for example, fluorescein dyes, rhodamine dyes (Rhodamine 6G (C.I. 45160), Rhodamine 6G Perchlorate, Rhodamine 6G Tetrafluoroborate, Rhodamine B (C.I. 45170), Rhodamine 3B Perchlorate, Rhodamine S (C.I. 45050), Rhodamine 19 Perchlorate, Rhodamine 101 Inner Salt, Rhodamine 110, Rhodamine 116, Rhodamine 123, and Solvent Rhodamine B conc. (C.I. 45170B)), rosaniline, coumarin dyes (coumarin-120, coumarin-314T), thionine, uranium and uranium-sensitized europium. In a most preferred embodiment, the fluorescent dye is a fluorescein dye.

Preferably, the fluorescent material is capable of exhibiting fluorescence even when added in small amounts. As a result, the material can be added in small amounts to the external additive and thereby not alter the properties of the external additive or toner.

In this regard, then, the upper limit on the amount of the fluorescent material is dependent upon the material selected in that the amount should not exceed an amount at which point the presence of the fluorescent material adversely affects the properties imparted to the toner by the external additive. The lower limit on the amount of the fluorescent material is also dependent upon the material selected in that the amount should be at least that amount required for the material to be detected upon exposure to ultraviolet light. As a guideline, the fluorescent material is preferably present in an amount of from about 0.001 to about 1,000 ppm, more preferably of from about 0.01 to about 100 ppm.

By "treated" as used herein is meant any treatment method in which the fluorescent material is incorporated into the external additive. The treatment may be physical in nature, for example involving simple mixing of the external additive with the fluorescent material, chemical in nature, for example bonding the fluorescent material to the external additive by any suitable technique, or a combination of both. Most preferably, the treatment is by way of mixing as this satisfactorily incorporates the fluorescent material into the external surface additive in a simple and efficient manner.

The fluorescent material is excitable upon exposure to ultraviolet light, and thus fluoresces under ultraviolet light. As such, the presence and amount of the external surface additive treated with the fluorescent material can be quickly determined through known methods using ultraviolet light exposure. That is, exposure of a solvent extract of the toner to ultraviolet light, that should include the treated external surface additive, can quickly and efficiently verify that the external surface additive is in fact present and also verify that it is present in the correct amount.

For quality control of remaining external surface additives, conventional techniques can then still be used, if needed or desired. Alternatively, different external surface additives could be treated with different fluorescent materials that fluoresce upon exposure to different wavelengths of ultraviolet light, thereby enabling the materials to be distinguished during quality control using various wavelengths of ultraviolet light. For example, blends of other external surface additives may be used on the toner such as varying types of titanium dioxides, aluminum oxides, or stearates. If these external additives are similarly treated with a fluorescent material, preferably different types of fluorescent material depending on the specific surface additive, then the concentrations and presence of each external additive can be readily determined.

What is claimed is:

1. A toner comprising a binder resin and a colorant, and at least one external surface additive upon the surface of the toner, wherein the at least one external surface additive contains a fluorescent material that fluoresces upon exposure to ultraviolet light to permit detection of the at least one external surface additive.

2. The toner according to claim 1, wherein the external surface additive is selected from the group consisting of silica, titania, aluminum oxide and zinc stearate.

3. The toner according to claim 1, wherein the toner includes an external surface additive package containing two different external surface additives of the same class, and one of the two different external surface additives of the same class is the at least one external surface additive containing the fluorescent material.

4. The toner according to claim 1, wherein the fluorescent material is a fluorescent dye.

5. The toner according to claim 4, wherein the fluorescent dye is selected from the group consisting of fluorescein dyes, rhodamine dyes, rosaniline, coumarin dyes, thionine, uranium and uranium-sensitized europium.

6. The toner according to claim 4, wherein the fluorescent dye is a fluorescein dye.

7. The toner according to claim 1, wherein the fluorescent material is present in an amount of from about 0.001 to about 1,000 ppm.

8. A method for detecting the presence and amount of an external surface additive upon a surface of a toner particle, the method comprising treating the external surface additive with a fluorescent material, incorporating the external surface additive onto the surface of the toner particle, and exposing the toner particle to ultraviolet light to cause the fluorescent material to fluoresce and thereby permit the detecting.

9. The method according to claim 8, wherein the external surface additive is selected from the group consisting of silica, titania, aluminum oxide and zinc stearate.

10. The method according to claim 8, wherein the external surface additive is silica.

11. The method according to claim 10, wherein the toner particle further includes an additional silica external surface additive that is not treated with the fluorescent material.

12. The method according to claim 8, wherein the fluorescent material is a fluorescent dye.

13. The method according to claim 12, wherein the fluorescent dye is selected from the group consisting of fluorescein dyes, rhodamine dyes, rosaniline, coumarin dyes, thionine, uranium and uranium-sensitized europium.

14. The method according to claim 12, wherein the fluorescent dye is a fluorescein dye.

15. The method according to claim 8, wherein the treating of the external surface additive with the fluorescent material incorporates an amount of from about 0.001 to about 1,000 ppm by weight of the fluorescent material into the external surface additive.

16. The method according to claim 8, wherein the treating is by mixing the external surface additive with the fluorescent material.

17. The method according to claim 8, wherein the incorporating is by blending the treated external surface additive with the toner particle.

* * * * *